US010852050B2

(12) United States Patent
Im et al.

(10) Patent No.: US 10,852,050 B2
(45) Date of Patent: Dec. 1, 2020

(54) REFRIGERATOR

(71) Applicant: LG Electronics Inc., Seoul (KR)

(72) Inventors: Jihyun Im, Seoul (KR); Dongjeong Kim, Seoul (KR); Hyunbum Kim, Seoul (KR); Jaehoon Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 289 days.

(21) Appl. No.: 15/968,281

(22) Filed: May 1, 2018

(65) Prior Publication Data

US 2019/0056165 A1 Feb. 21, 2019

(30) Foreign Application Priority Data

Aug. 21, 2017 (KR) ..... 10-2017-0105256

(51) Int. Cl.

*F25D 17/08* (2006.01)
*F25D 17/06* (2006.01)
*F25D 23/04* (2006.01)
*F25D 23/02* (2006.01)

(52) U.S. Cl.

CPC ..... *F25D 17/065* (2013.01); *F25D 17/062* (2013.01); *F25D 23/025* (2013.01); *F25D 23/04* (2013.01); *F25D 2317/061* (2013.01); *F25D 2317/062* (2013.01);

(Continued)

(58) Field of Classification Search

CPC ..... F25D 17/06; F25D 17/04; F25D 17/065; F25D 17/045; F25D 11/02; F25D 17/042; F25D 17/062; F25D 17/067; F25D 2317/06; F25D 2317/063; F25D 2317/066; F25D 2317/0664; F25D 2317/0665; F25D 2317/0666; F25D 2317/0667; F25D 23/04;

(Continued)

(56) References Cited

U.S. PATENT DOCUMENTS 9,341,402 B1 * 5/2016 Loudermilk ..... F25C 5/182
2005/0011219 A1 1/2005 Asan et al.

(Continued)

FOREIGN PATENT DOCUMENTS

EP 3163231 5/2017
KR 2007115223 12/2007

OTHER PUBLICATIONS

European Extended Search Report in European Application No. 18166763.5, dated Nov. 14, 2018, 11 pages.

*Primary Examiner* — Vivek K Shirsat
*Assistant Examiner* — Ko-Wei Lin
(74) *Attorney, Agent, or Firm* — Fish & Richardson P.C.

(57) ABSTRACT

A refrigerator includes a cabinet that defines a first storage compartment and an opening at a front side of the first storage compartment, an inner door that is configured to open and close at least a portion of the first storage compartment and that defines a second storage compartment configured to store one or more items, an outer door configured to open and close at least a portion of the second storage compartment, a cold air supply unit configured to supply cold air to each of the first storage compartment and the second storage compartment, and a cold air duct located in the first storage compartment and configured to, based on the inner door being oriented in an open position or a closed position, selectively communicate with the cold air supply unit and the second storage compartment.

19 Claims, 8 Drawing Sheets

(52) U.S. Cl.
CPC ..... *F25D 2317/0671* (2013.01); *F25D 2317/0672* (2013.01); *F25D 2317/0681* (2013.01); *F25D 2323/023* (2013.01)

(58) Field of Classification Search
CPC .. F25D 23/028; F25D 17/08; F25D 2317/062; F25D 23/025; F25D 2317/067
USPC ..... 454/173, 183; 62/440, 441, 428
See application file for complete search history.

(56) References Cited

U.S. PATENT DOCUMENTS

| | | | | |
|---|---|---|---|---|
| 2012/0023997 | A1* | 2/2012 | Jung | F25C 5/22 62/340 |
| 2013/0305771 | A1* | 11/2013 | Kim | F25D 23/068 62/344 |
| 2013/0327082 | A1* | 12/2013 | Son | F25C 1/00 62/344 |
| 2016/0370083 | A1* | 12/2016 | Koo | F25C 1/04 |
| 2017/0122648 | A1* | 5/2017 | Park | F25D 17/062 |
| 2017/0159992 | A1* | 6/2017 | Eom | F25D 23/025 |
| 2017/0292762 | A1* | 10/2017 | Moon | F25D 23/006 |
| 2018/0224184 | A1* | 8/2018 | Mitchell | F25D 17/065 |

* cited by examiner

REFRIGERATOR

CROSS-REFERENCE TO RELATED APPLICATIONS

This application claims the benefit of Korean Patent Application No. 10-2017-0105256, filed on Aug. 21, 2017, which is hereby incorporated by reference as if fully set forth herein.

FIELD

The present disclosure relates to a refrigerator and, more particularly, to a refrigerator configured to directly supply cold air to a storage compartment provided in a door.

BACKGROUND

A refrigerator may keep food fresh by cooling a storage compartment based on repeating a refrigeration cycle.

For example, a refrigerator may include a compressor which may compress refrigerant, through a refrigeration cycle, into high-temperature and high-pressure refrigerant. The refrigerant compressed by the compressor may cool air while passing through a heat exchanger, and the cooled air may be supplied into a freezing compartment or a refrigerating compartment.

The refrigerator may have a configuration in which the storage compartment is divided into the refrigerating compartment and the freezing compartment, and the freezing compartment is at the upper side and the refrigerating compartment is at the lower side, for instance. A door provided on the front side of the refrigerator may preserve cold air in the refrigerating compartment and the freezing compartment.

A side-by-side-type refrigerator may include a freezing compartment and a refrigerating compartment that are arranged side by side, for example, on the left and right sides, respectively. In some examples, another type of refrigerator may include a single storage compartment that is provided at the upper side or the lower side and that may be opened by two doors arranged side by side.

In some cases, a refrigerator may lose cold air when the door is opened because the user needs to open the freezing compartment door or the refrigerating compartment door in order to take out food stored in the freezing compartment or the refrigerating compartment.

Recently, a refrigerator, which includes a storage compartment referred to as a "home bar" provided on a door, has been introduced. The home bar is a storage space in which may accommodate food, beverage, or the like that are frequently introduced or discharged. The refrigerator is opened or closed by a home bar door, which is separately provided, in a state in which the freezing compartment door or the refrigerating compartment door is closed. When the home bar door is opened/closed, a loss of cold air may be reduced compared to the case of opening the freezing compartment door or the refrigerating compartment door because a small communication area between the home bar and an outside is exposed.

In some examples, while the freezing compartment or the refrigerating compartment directly receives cold air from the refrigeration cycle, the home bar may be configured such that cold air, which has passed through the freezing compartment or the refrigerating compartment, is introduced into the home bar through an opening formed in the inner surface of the home bar, where the opening in the home bar may not be made large in order to prevent food stored in the home bar from falling to the freezing compartment or the refrigerating compartment. Therefore, the home bar has difficulty in maintaining a low temperature therein.

In examples where cold air, which is supplied from a multi-duct located at the rear of the freezing compartment or the refrigerating compartment, mostly reaches to an upper region of the storage space of the home bar, a lower storage space of the home bar may have difficulty in receiving cold air than the upper storage space and in maintaining a low temperature.

Therefore, improvement of a cold air supply method may be of interest in order to smoothly and uniformly supply cold air.

SUMMARY

The present disclosure may provide a refrigerator, which directly supplies cold air to a home bar provided in a door to maintain the home bar at a low temperature.

The present disclosure may also provide a refrigerator, which may not require a separate cooling device for supplying cold air to a home bar.

In addition, the present disclosure may provide a refrigerator, which may realize an even temperature distribution in an upper space and a lower space of a home bar.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

According to one aspect of the subject matter described in this application, a refrigerator includes a cabinet that defines a first storage compartment and an opening at a front side of the first storage compartment, an inner door that is configured to open and close at least a portion of the first storage compartment and that defines a second storage compartment configured to store one or more items, an outer door configured to open and close at least a portion of the second storage compartment, a cold air supply unit configured to supply cold air to each of the first storage compartment and the second storage compartment, and a cold air duct located in the first storage compartment and configured to, based on the inner door being oriented in an open position or a closed position, selectively communicate with the cold air supply unit and the second storage compartment.

Implementations according to this aspect may include one or more of the following features. For example, the refrigerator may further include a hinge unit located at a first side of the cabinet and configured to rotatably couple the inner door to the cabinet, where the cold air duct extends from a first position in the first storage compartment toward the first side of the cabinet, and is configured to supply cold air through a side surface of the inner door that is located closer to the first side of the cabinet than to the first position in the first storage compartment.

In some implementations, the cold air supply unit is located at a rear side of the first storage compartment, and the cold air duct may include a suction duct located on a rear surface of the first storage compartment and configured to receive cold air from the cold air supply unit, and a supply duct located on a side surface of the first storage compartment and connected to the suction duct, the supply duct being configured to receive cold air from the suction duct and supply the received cold air to the inner door. The supply duct may include a first inclined surface that slopes with respect to the side surface of the first storage compartment and that defines a cold air discharge hole configured to communicate with the inner door. The inner door may include a second inclined surface that slopes with respect to the side surface of the first storage compartment, that is configured to face the first inclined surface of the supply duct, and that defines a cold air introduction hole configured to receive cold air from the supply duct through the cold air discharge hole.

In some implementations, the second storage compartment may include an upper storage compartment and a lower storage compartment located vertically below the upper storage compartment, and the cold air duct is configured to supply cold air to the lower storage compartment. The cabinet may include an inner case that defines the first storage compartment, and an outer case that surrounds the inner case, and the cold air supply unit may be located between the inner case and the outer case and is configured to communicate with the cold air duct. The cold air supply unit may include a heat exchanger configured to generate cold air by exchanging heat with air received from outside of the refrigerator, a fan configured to cause cold air to flow toward the cold air duct, and a shroud that supports the fan and that is configured to communicate with the cold air duct. The suction duct may be located on an inner surface of the inner case.

In some examples, the refrigerator may further include an expansion portion located at a connecting portion between the suction duct and the shroud, where a cross-sectional area of the expansion portion is greater than a cross-sectional area of the shroud, and the suction duct is connected to the shroud and is located forward of the shroud. The suction duct may include an insulator configured to insulate the suction duct from the first storage compartment. In some examples, the cold air duct may protrude from an inner surface of the inner case toward an interior of the first storage compartment. The inner case may cover at least a portion of the supply duct.

In some implementations, the inner case may include a duct mounting portion that defines a recess configured to receive the supply duct, and the duct mounting portion may be spaced apart from the outer case by a distance and is configured to insulate the supply duct from the outer case. In some examples, the suction duct may protrude from an inner surface of the inner case toward an interior of the first storage compartment, and the supply duct is located between the inner case and the outer case. The outer case may include an insulator located on an inner surface of the outer case that faces toward the supply duct.

In some implementations, the supply duct is configured to separate from the inner door based on the inner door opening the first storage compartment by rotation of the hinge unit in a first direction, and connect to the inner door based on the inner door closing the first storage compartment by rotation of the hinge unit in a second direction opposite to the first direction. The cold air introduction hole may be configured to, based on the inner door being oriented in a closed position, communicate with the cold air discharge hole. A width of the supply duct may be less than the distance between the duct mounting portion and the outer case. In some examples, the supply duct may be spaced apart from the duct mounting portion by a distance that is less than the width of the supply duct It is to be understood that both the foregoing general description and the following detailed description of the present disclosure are exemplary and explanatory and are intended to provide further explanation of the present disclosure as claimed.

DETAILED DESCRIPTION

A refrigerator may define a food storage space configured to block heat from the outside by a cabinet and a door filled with an insulator, and may include a freezing device such as an evaporator configured to absorb heat inside of the food storage space, and a radiator configured to discharge the collected heat to the outside of the food storage space, thereby maintaining the food storage space at a low-temperature, in which survival and proliferation of microorganisms may be limited, to preserve the stored food for a long period of time.

The refrigerator is divided into a refrigerating compartment, which is an area in which food is stored at a temperature above zero, and a freezing compartment, which is an area in which food is stored at a temperature below the zero degrees. According to the arrangement of the freezing compartment and the refrigerating compartment, the refrigerator is classified into a top-freezer-type refrigerator having an upper freezing compartment and a lower refrigerating compartment, a bottom-freezer-type refrigerator having a lower freezing compartment and an upper refrigerating compartment, and a side-by-side-type refrigerator having a left freezing compartment and a right refrigerating compartment.

In addition, in order to allow a user to conveniently put or discharge food stored in the food storage space, the refrigerator includes a plurality of shelves and drawers and the like in the food storage space.

Hereinafter, example implementations of the present disclosure will be described with reference to the accompanying drawings.

Figure 1:
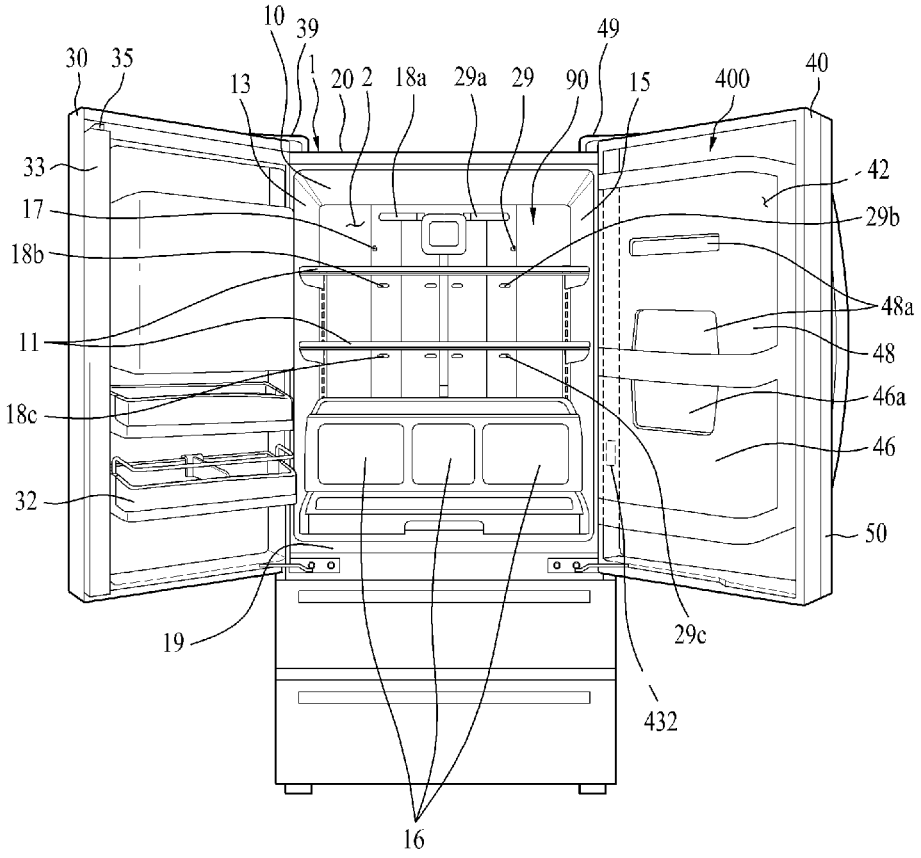
FIG. 1 is a front view illustrating an example refrigerator.
Figure 2:
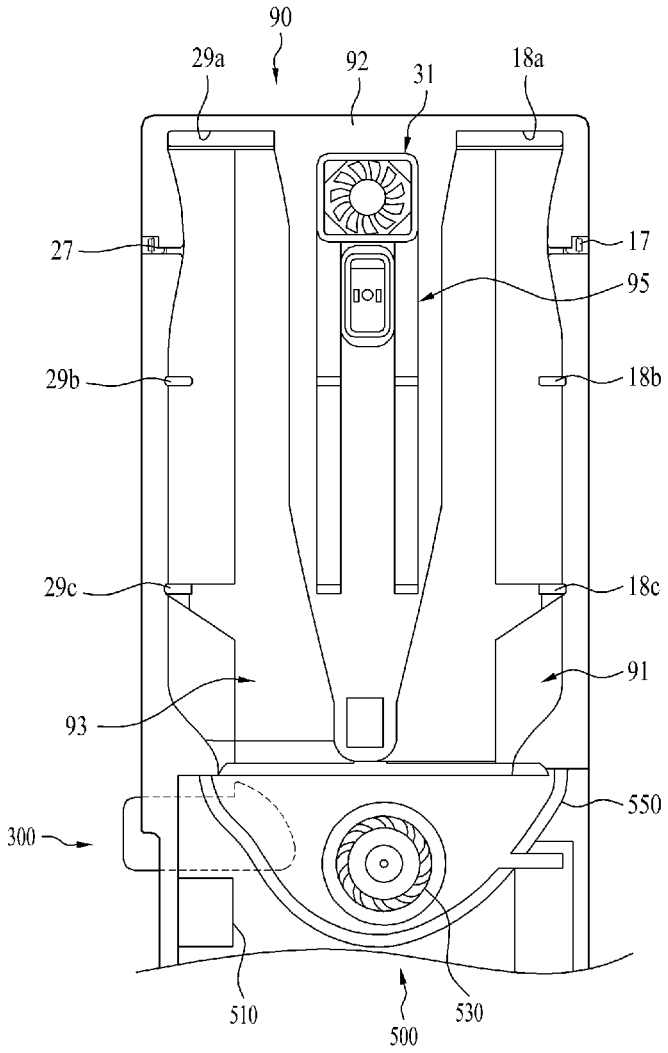
FIG. 2 is a view illustrating a rear side of an example multi-duct and an example cold air duct that are connected to an example cold air supply unit.
Figure 3:
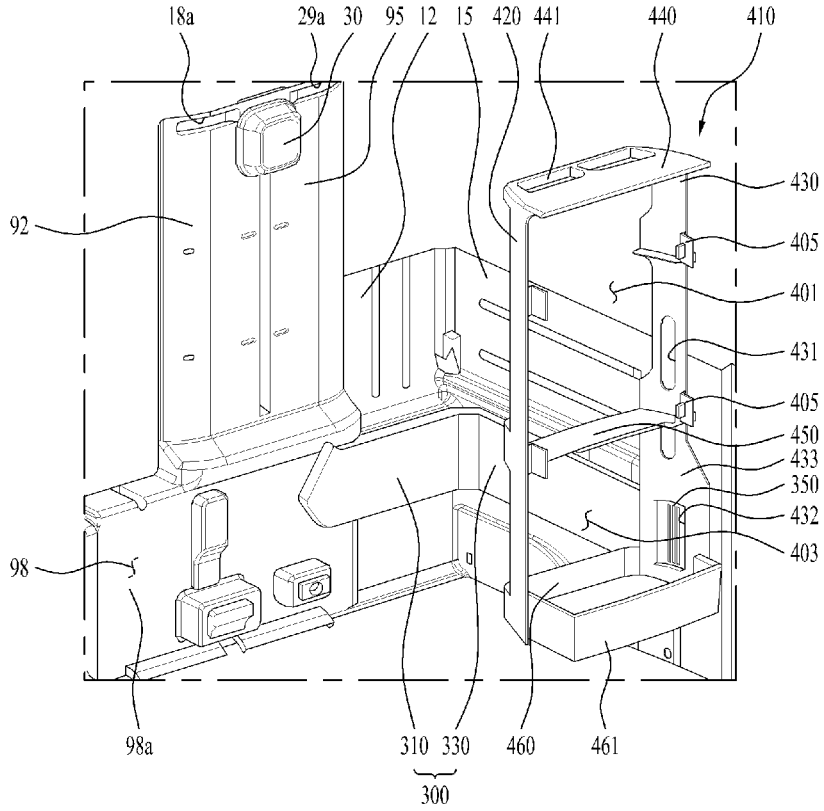
FIG. 3 is a view illustrating an example arrangement of the cold air duct connected to an example door.

Referring to FIGS. 1 to 3, an example refrigerator includes a cabinet 1 defining the external appearance of the refrigerator. FIG. 1 illustrates a front view of the refrigerator, FIG. 2 illustrates a rear side view showing an example multi-duct 90 and an example cold air duct 300, which are connected to an example cold air supply unit 500, and FIG. 3 illustrates an example arrangement of the cold air duct 300 connected to an example door.

The cabinet 1 includes an inner case 10, which defines a first storage compartment 2 configured to store food, and an outer case 20, which is spaced apart from the inner case 10 by a predetermined distance, surrounds the inner case 10, and defines an external appearance of the refrigerator. In some examples, the space between the inner case 10 and the outer case 20 may be filled with an insulator.

The first storage compartment 2 defined by the inner case 10 includes a rear surface 12, a left surface 13, a right surface 15, and a bottom surface 19, which define the rear surface, the left surface, the right surface, and the bottom of the first storage compartment 2, respectively. The front side of the first storage compartment 2 can be opened to allow the user to introduce food into the first storage compartment 2 or to take food from the first storage compartment 2, through the open front side of the first storage compartment 2.

In some examples, the first storage compartment 2 may include a freezing compartment and a refrigerating compartment, but will be referred to as a refrigerating compartment unless particularly mentioned below.

In the first storage compartment 2, a plurality of shelves 11 may be disposed to store various foods at different heights. The shelves 11 may extend to interconnect the left surface 13 and the right surface 15 of the first storage compartment 2.

The first storage compartment 2 may include a drawer 16, which is capable of storing food in a hermetically sealed state inside the storage compartment. A plurality of drawers 16 may be provided so that various foods are divided and stored in the respective drawers 16. The drawers 16 may be provided so as to be introduced or discharged in a longitudinal direction so that the user may move the drawers 16 after introducing or discharging food into or from the drawers 16.

A first door 30 is provided on one side of the first storage compartment 2 to open or close one side of the storage compartment. The first door 30 is rotatably provided on one end of the cabinet 1 by a first hinge unit 39 so that the user can open and close one side, for example, the left side of the first storage compartment 2.

The first door 30 may include a shelf 32, which allows the user to store food in the first door 30. At this time, the shelf 32 may have a rear wall having a predetermined height to prevent food from falling from the shelf 32.

The first door 30 may include a pillar 33, which is rotated so as to come into contact with an inner door 40, which will be described later. The pillar 33 may have a rectangular shape in entirety, and may be coupled to the first door 30 so as to rotate relative to the first door 30. At this time, the pillar 33 may be disposed at different rotation angles relative to the first door 30 according to the rotation angle of the first door 30 relative to the first storage compartment 2 or according to whether the first door 30 opens or closes the first storage compartment 2.

The pillar 33 has a length shorter than the distance between the top surface and the bottom surface 19 of the inner case 10 so as not to come into contact with the top surface and the bottom surface. That is, even if the first door 30 is rotated to hermetically seal the first storage compartment 2, the pillar 33 does not come into contact with both the top surface and the bottom surface 19. In some cases, due to the structural shape of the inner case 10, for example, as no element is disposed on the top surface and the bottom surface 19 to restrain rotation of the pillar 33, each of the top surface and the bottom surface 19 may define a single plane in entirety.

A pillar protrusion 35 is located at the top of the pillar 33, and protrudes so as not to come into contact with the top surface (e.g., the ceiling).

The inner door 40 may be provided on the other side of the first storage compartment 2 and is rotated to open or close the other side of the storage compartment. An outer door 50 is provided on the front side of the inner door 40 to open or close an opening provided in the inner door 40.

Both the inner door 40 and the outer door 50 may be rotatably provided on the cabinet 1 independently of each other. The inner door 40 is rotatably coupled to the cabinet 1 by a second hinge unit 49. The outer door 50 may be rotatably coupled to the inner door 40.

The user may open or close the other side of the first storage compartment 2 by rotating the inner door 40 and the outer door 50 together. In addition, the user may open or close the front side of the inner door 40 by rotating the outer door 50 in the state in which the inner door 40 closes the other side of the first storage compartment 2. A handle is provided on the front side of the outer door 50 so that the user can grip and rotate the outer door 50.

The inner door 40 may define a second storage compartment 42 configured to store food. The second storage compartment 42 may be a space separated from the outer door 50 and may not be located in the outer door 50. The second storage compartment 42 may have an opening, the front side of which may be opened or closed by the outer door 50. The user may access the second storage compartment 42 to introduce or discharge food or the like into or from the second storage compartment 42 through the opening.

In some examples, the inner door 40 may include an accommodating unit 400.

The second storage compartment 42 may be defined inside of the accommodating unit 400. The accommodating unit 400 protrudes from the rear surface of the inner door 40 and vertically extends a long length, in order to secure a sufficient size of the second storage compartment 42.

The accommodating unit 400 may include an accommodating case 410 and a shelf 461 seated in the accommodating case 410 illustrated in FIG. 3. In some examples, as illustrated in FIG. 3, the accommodating case 410 may include a first side frame 420 and a second side frame 430, which form opposite side surfaces, a top frame 440, which forms the top surface, a lower support frame 460, which forms the bottom of the accommodating case 410 and supports the shelf 461, and a upper support frame 450, which vertically divides the inner space in the accommodating case 410, is configured to support a shelf, and is located above the lower support frame 460.

The first side frame 420 is located on the side surface close to the first door 30, and the second side frame 430 is located close to the second hinge unit 49. Each of the first side frame 420 and the second side frame 430 is provided with a coupler 405, which couples the accommodating case 410 to the inner door 40.

In some examples, in order to enable introduction of cold air into the first storage compartment 2, each of the first side frame 420 and the second side frame 430 is formed with a side frame cold air hole 431, and the top frame 440 is formed with a top frame cold air hole 441.

The lower support frame 460 and the upper support frame 450 extend to across the accommodating case 410 in the horizontal direction so as to interconnect the first side frame 420 and the second side frame 430. Thus, a second upper storage compartment 401 is formed between the upper support frame 450 and the top frame 440, and a second lower storage compartment 403 is formed between the upper support frame 450 and the lower support frame 460.

The lower shelf 461 is seated on the lower support frame 460, and an upper shelf may be seated on the upper support frame 450. The user may store foods having different heights on the lower shelf 461 or the upper shelf in the second storage compartment 42.

The accommodating unit 400 may be provided on the rear side thereof with covers 46 and 48, and a portion of the second storage compartment 42 may be hermetically sealed from the first storage compartment 2. The covers 46 and 48 include an upper cover 48, which is located between the top frame 440 and the upper support frame 450, and a lower cover 46, which is located between the upper support frame 450 and the lower support frame 460.

Thus, the upper cover 48 hermetically seals a portion of the second upper storage compartment 401 from the first storage compartment 2, and the lower cover 46 hermetically seals a portion of the second lower storage compartment 403 from the first storage compartment 2.

In some implementations, the covers 46 and 48 may have a plurality of cold air holes 48*a* and 46*a* to allow the cold air of the first storage compartment 2 to be introduced into the second storage compartment 42. The cold air holes 48*a* and 46*a* communicate the first storage compartment 2 and the second storage compartment 42 with each other.

For example, the upper cover 48 may define upper cover cold air holes 48*a* located respectively in the upper portion and the lower portion of the upper cover 48. The lower cover 46 may define a lower cover cold air hole 46*a* only at an upper portion of the lower cover 46. This is because the lower end portion of the lower cover 46 is located close to the drawer 16 when the inner door 40 is closed, and therefore has difficulty in receiving cold air even if a cold air hole is formed therein. In this case, it may be difficult to maintain the second lower storage compartment 403 at a low temperature by the lower cover 46.

In some examples, the second side frame 430 may define a cold air introduction hole 432, in order to directly receive cold air through a duct from a cold air supply unit 500, which will be described below, without passing through the first storage compartment 2. This will be described later in detail.

A multi-duct 90 is provided on the rear surface of the first storage compartment 2 to supply cold air into the storage compartment.

The multi-duct 90 may be defined by a multi-duct cover 92, which is exposed to the first storage compartment 2, and may include an insulating member, which hermetically seals the rear side of the multi-duct cover 92. The multi-duct 90 may receive cold air, which passes through the space between the multi-duct cover 92 and the insulating member, from the cold air supply unit 500, and supply the cold air to the first storage compartment 2.

The multi-duct 90 may have a plurality of discharge holes capable of supplying cold air to the first storage compartment 2, and may supply cold air through the discharge holes to various positions in the first storage compartment 2. To this end, the multi-duct 90 includes a first multi-duct 91 and a second multi-duct 93.

The first multi-duct 91 has a first upper discharge hole 18*a*, a first middle discharge hole 18*b*, and a first lower discharge hole 18*c*, which discharge cold air toward the first door 30. The second multi-duct 93 has a second upper discharge hole 29*a*, a second middle discharge hole 29*b*, and a second lower discharge hole 29*c*, which discharge cold air toward the inner door 40.

The multi-duct 90 is formed with a first discharge hole 17 between the first upper discharge hole 18*a* and the first middle discharge hole 18*b*, and a second discharge hole 27 between the second upper discharge hole 29*a* and the second middle discharge hole 29*b*.

The first discharge hole 17 may be disposed closer to the left surface 13 of the first storage compartment 2 than the first upper discharge hole 18*a* and the first middle discharge hole 18*b*. Thus, the first discharge hole 17 may be provided at a height and a horizontal position different from the first upper discharge hole 18*a* and the first middle discharge hole 18*b*, thereby supplying cold air to various positions in the first storage compartment 2.

The second discharge hole 27 may be disposed closer to the right surface 15 of the first storage compartment 2 than the second upper discharge hole 29*a* and the second middle discharge hole 29*b*. Thus, the second discharge hole 27 may be provided at a height and a horizontal position different from the second upper discharge hole 29*a* and the second middle discharge hole 29*b*, thereby supplying cold air to various positions in the first storage compartment 2.

When cold air is supplied from the cold air supply unit 500, the flow of cold air moving upward may be generated, and the air inside the multi-duct 90 may be discharged to the first storage compartment 2 through the discharge holes.

A bacteria removal duct 95 may be provided on the rear surface of the first storage compartment 2 to supply air, from which bacteria is removed, to the storage compartment. The bacteria removal duct 95 is disposed in the space defined by the multi-duct cover 92. In addition, the bacteria removal duct 95 communicates with a filter module, which is located in the upper region of the first storage compartment 2 and includes a filter fan 31 and a filter, to supply air, from which bacteria is removed by the filter module, to various positions in the first storage compartment 2.

In some examples, the cold air supply unit 500 is provided at the rear of the first storage compartment 2 to supply cold air to the multi-duct 90.

The cold air supply unit 500 functions to produce cold air and introduce the cold air to the duct by a fan.

The cold air supply unit 500 may be provided at the rear of the first storage compartment 2. Specifically, the cold air supply unit 500 is provided in a cooling chamber 98 provided in the space between the inner case 10 and the outer case 20. The cooling chamber 98 may be separated from the first storage compartment 2 by the rear surface of the inner case 10, without being limited thereto. For example, the cooling chamber 98 may protrude from the inner case 10, but may be separated from the first storage compartment 2 by a chamber cover 98*a*.

The cold air supply unit 500 includes a heat exchanger 510, which generates cold air via heat exchange with outside air, a blowing fan 530, which moves the cold air, and a shroud 550 in which the blowing fan 530 is mounted.

The heat exchanger 510 may suction and cool the outside air, and may include an evaporator of a refrigeration cycle. In some examples, a machine room may be provided at the rear of the lower end portion of the cabinet 1 so that a compressor and a condenser, which compress refrigerant and condenses the compressed refrigerant to transfer the refrigerant to the evaporator 510, are provided in the machine room. The evaporator 510 is connected to the compressor and the condenser via a refrigerant pipe.

The shroud 550 is connected to each of the first multi-duct 91 and the second multi-duct 93 so that cold air is introduced into the first multi-duct 91 and the second multi-duct 93 by the blowing fan 530. Thus, the cold air may be supplied to the first storage compartment 2.

In some examples, the shroud 550 is connected to the cold air duct 300 so as to directly supply cold air to the second storage compartment 42 of the inner door 40.

As illustrated in FIG. 3, the cold air duct 300 is provided in the first storage compartment 2, and selectively communicates the cold air supply unit 500 and the second storage compartment 42 with each other via the opening or closing operation of the inner door 40.

For example, when the inner door 40 closes the first storage compartment 2, the cold air duct 300 may be connected to the side surface of the inner door 40 that is close to the second hinge unit 49, and may supply cold air to the second storage compartment 42 of the inner door 40. When the inner door 40 opens the first storage compartment 2, the cold air duct 300 may be spaced apart from the side surface of the inner door 40 that is close to the second hinge unit 49, and may not supply cold air to the second storage compartment 42. In this case, the cold air discharged from the cold air duct 300 may be supplied to the first storage compartment 2 when the inner door 40 opens the first storage compartment 2.

The side surface of the inner door 40 close to the second hinge unit 49 may be the side surface close to the inner case 10. In FIG. 3, the structure in which the cold air duct 300 is selectively connected to the side surface of the inner door 40 that is located on the right surface of the inner case 10 is illustrated, for instance.

The cold air duct 300 is disposed on the lower end portion of the first storage compartment 2 so as to supply cold air to the second lower storage compartment 403. The cold air duct 300 includes a suction duct 310, which is provided on the rear surface of the first storage compartment 2 so that cold air is introduced thereinto from the cold air supply unit 500, and a supply duct 330, which is provided on the side surface 15 of the first storage compartment 2 and is connected to the suction duct 310 so as to supply the cold air to the inner door 40. As described above, the rear surface of the first storage compartment 2 is formed by the rear surface of the inner case 10, and the side surface 15 of the first storage compartment 2 is formed by the side surface of the inner case 10.

The supply duct 330 is provided on the side surface 15 of the first storage compartment 2 and extends forward from the rear surface of the first storage compartment 2. The supply duct 330 includes a first slope 340 inclined toward the side surface of the inner door 40, and a cold air discharge hole 350 formed in the first slope 340.

When the inner door 40 rotates, the side surface of the inner door 40 is located so as to approximately face the side surface of the supply duct 330. In this case, when the supply duct 330 discharges cold air in a direction parallel to the longitudinal direction of the supply duct 330, the discharged cold air is not directed to the inner door 40. Therefore, a separate element is required to communicate the supply duct 330 and the inner door 40 with each other in order to introduce the cold air into the inner door 40. In some cases, when the supply duct 330 discharges cold air in a direction orthogonal to the longitudinal direction of the supply duct 330, it may be necessary to apply high resistance to the flow of cold air, and therefore, the cold air may not be smoothly supplied.

The first slope 340 allows the cold air to be smoothly supplied from the supply duct 330 to the second storage compartment 42 of the inner door 40.

The first slope 340 defines a cold air discharge hole 350, and the cold air discharge hole 350 may include a discharge guide rib 351, which directs the cold air to the side surface of the inner door 40.

In some examples, the inner door 40 may include a second slope 433 inclined to face the first slope 340 (see FIG. 5), and a cold air introduction hole 432 formed in the second slope 433. Thus, the loss of cold air discharged from the cold air discharge hole 350 is minimized in the course of being introduced into the cold air introduction hole 432.

In some examples, the suction duct 310 extends from the position on the rear surface of the first storage compartment 2 at which the cold air supply unit 500 is located to the side surface 15 of the first storage compartment 2, and one end of the suction duct 310 is connected to the cold air supply unit 500 and the other end is connected to the supply duct 330.

Figure 4:
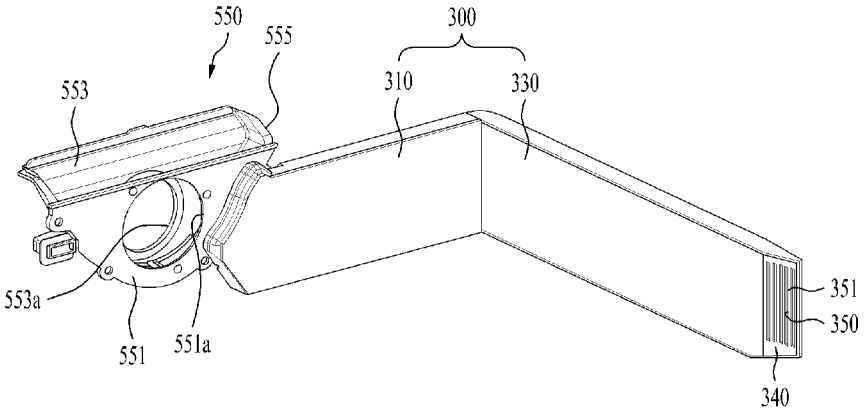
FIG. 4 is a view illustrating an example shroud connected to the cold air duct.
Figure 5:
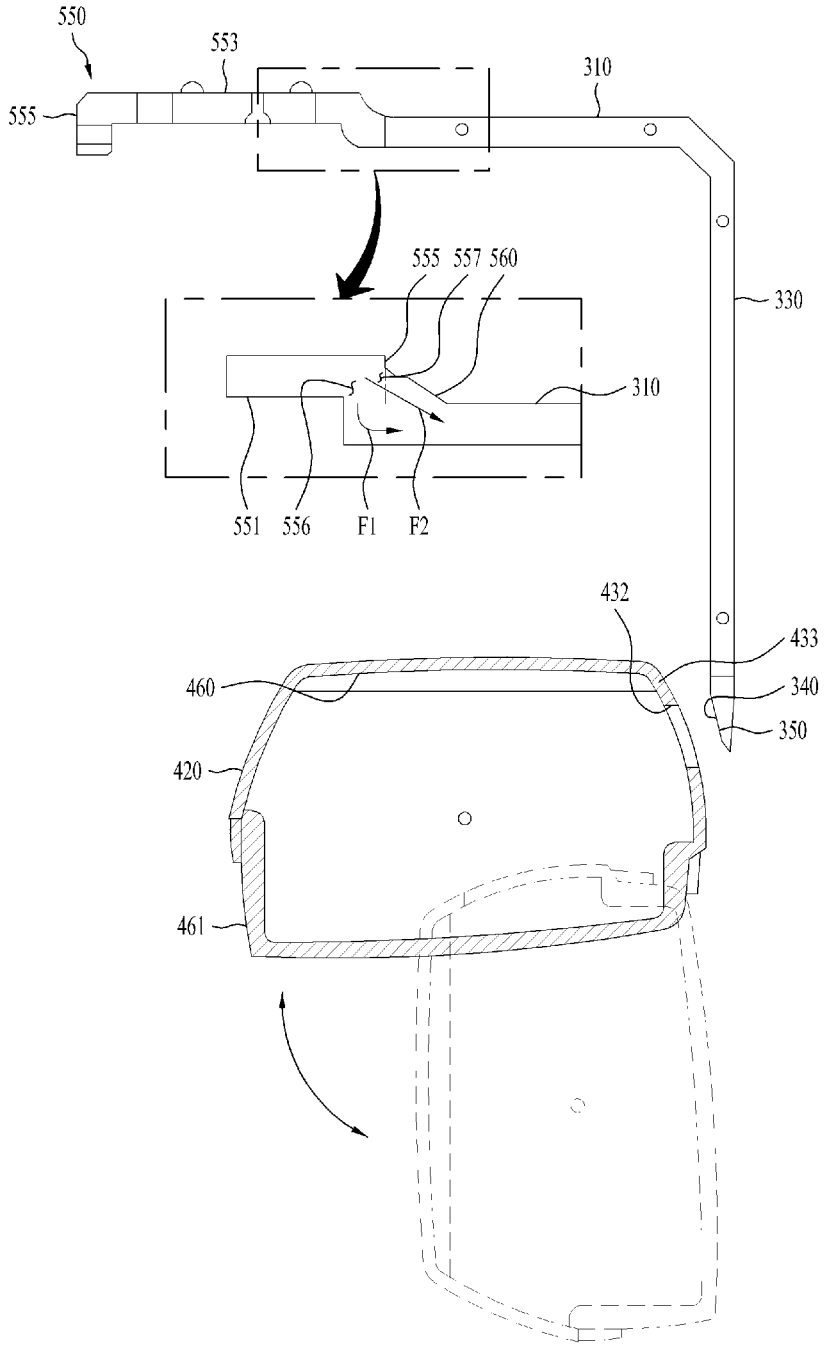
FIG. 5 is a plan view illustrating a cross section of the shroud and the cold air duct illustrated in FIG. 4.

Hereinafter, the connection relationship between the cold air supply unit 500 and the cold air duct 300 will be described with reference to FIGS. 4 and 5. FIG. 4 is a view for explaining the connection relationship between the shroud 550 and the cold air duct 300, and FIG. 5 is a plan view illustrating the cross section of the shroud 550 and the cold air duct 300 illustrated in FIG. 4.

The shroud 550 has an open top side, and includes a front panel 551, which forms the front surface, a rear panel 553, which forms the rear surface, and a single connection panel 555, which forms the side surface and the bottom surface. The open top side communicates with the multi-duct 90.

The front panel 551 is formed with a mounting hole **551*a* in which the blowing fan 530 is mounted, and the rear panel 553 is formed with an introduction hole 553*a*, into which cold air cooled by the evaporator 510 is introduced. The mounting hole 551*a* and the introduction hole 553*a*** may be formed at opposite positions.

For example, the blowing fan 530 may be a turbo fan. The turbo fan 530 circumferentially discharges the air introduced in the axial direction. Thus, in order to smoothly discharge cold air to the multi-duct 90 disposed thereabove, the connection panel 555 is downwardly convexly curved.

In some examples, the front panel 551 may define a front through-hole 556, from which cold air is discharged, and the connection panel 555 may define a side through-hole 557, from which cold air is discharged.

The suction duct 310 is provided on the rear surface of the first storage compartment 2 to protrude therefrom, and communicates with the shroud 550 for communication with the cold air supply unit 500. The suction duct 310 communicates with the shroud 550 through the front through-hole 556 and the side through-hole 557, in order to allow the cold air discharged from the shroud 550 to be introduced thereinto without receiving a high resistance.

For example, the side surface of the suction duct 310 communicates with the shroud 550 through the front through-hole 556 as the front panel 551 comes into contact with the side surface of the suction duct 301. In some examples, the side surface of the suction duct 301 is spaced apart from the connection panel 555, but may communicate with the shroud 550 through a connection expansion portion 560, which is connected to the side through-hole 557.

The connection expansion portion 560 increases the cross-sectional area of the connecting portion between the suction duct 310 and the shroud 550, thereby minimizing resistance applied to the cold air. The connection expansion portion 560 is connected at one side thereof to the shroud 550 and at the other side thereof to the suction duct 310, and includes a slope provided between one side and the other side.

A first flow-path F1 is formed to pass through the front through-hole 556, and a second flow-path F2 is formed to pass through the side through-hole 557 and the connection expansion portion 560, which helps smooth movement of the cold air.

The second storage compartment 42 of the inner door 40 directly receives cold air from the cold air supply unit 500 through the cold air introduction hole 432 formed in the second side frame 430. The second slope 433 is formed in the second side frame 430. In particular, the cold air introduction hole 432 and the second slope 433 are formed in the lower end portion of the second side frame 430 so as to introduce the cold air into the second lower storage compartment 403.

As illustrated in FIG. 5, the cold air discharged from the supply duct 330 moves in the diagonal direction and is introduced into the cold air introduction hole 432 in the inner door 40. For example, the diagonal direction may be a direction that is inclined by a predetermined angle relative to the side surface 15 of the first storage compartment 2.

Figure 7:
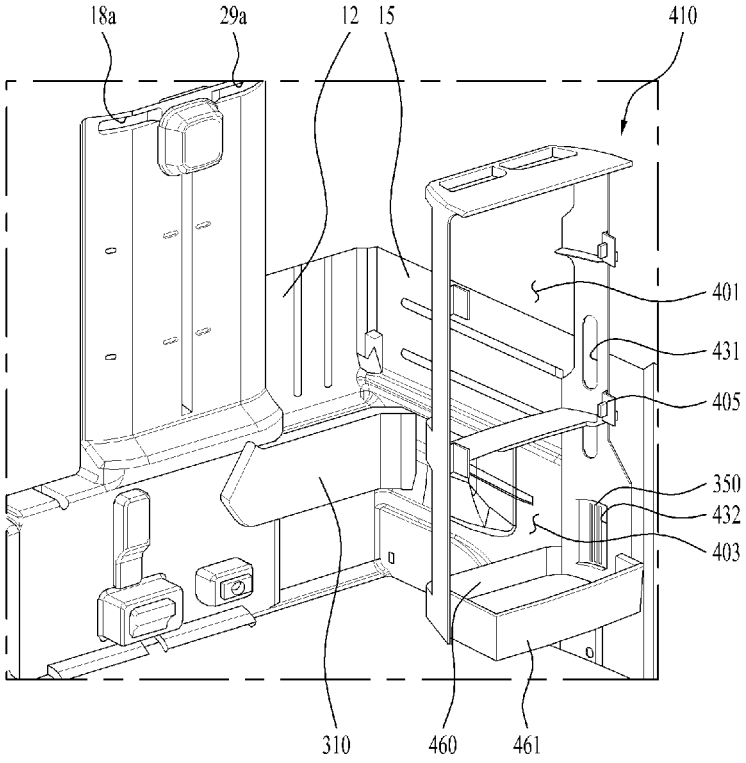
FIG. 7 is a view illustrating another example arrangement of the cold air duct connected to the door.

In some examples, the supply duct 330 may protrude from the side surface 15 of the first storage compartment 2, as illustrated in FIG. 3, and may be inserted into the side surface 15 of the first storage compartment, as illustrated in FIG. 7.

Figure 6:
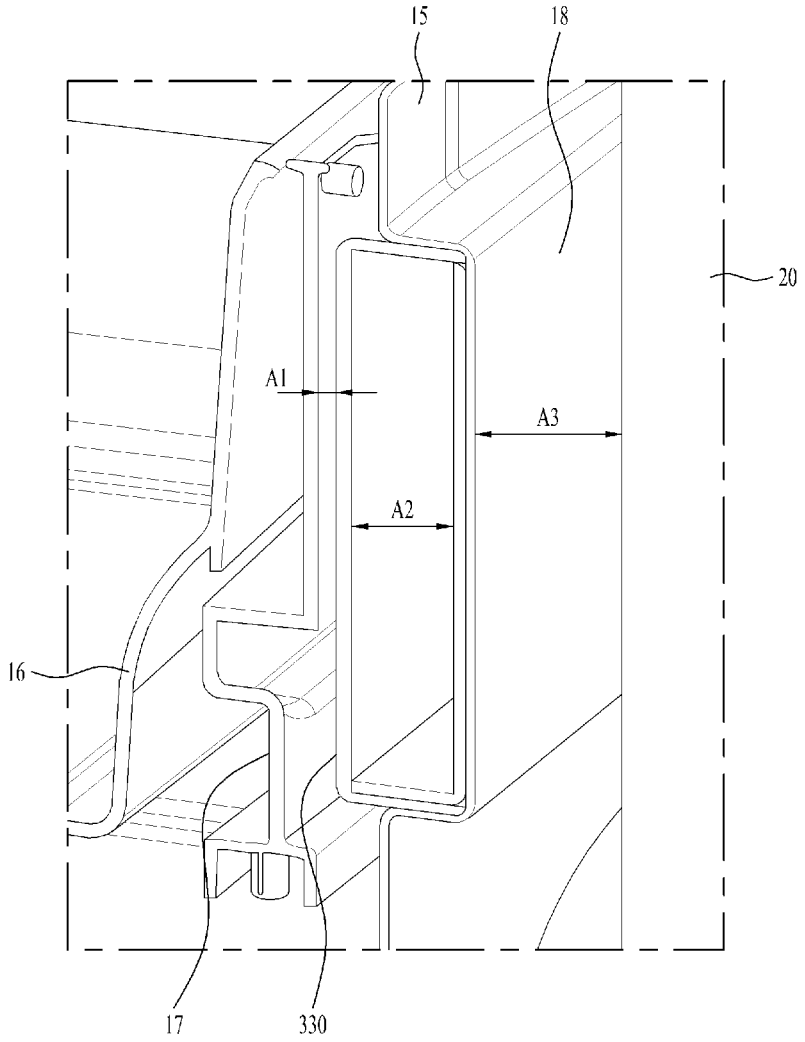
FIG. 6 is a side cross-sectional view illustrating an example inner case coupled to the cold air duct illustrated in FIG. 3.
Figure 8:
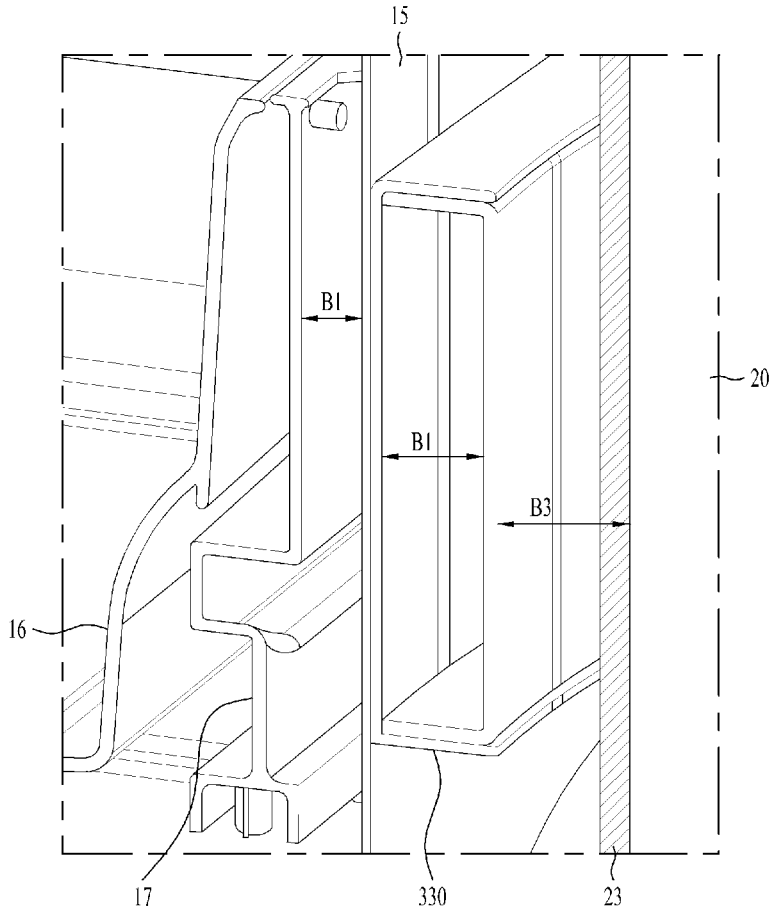
FIG. 8 is a side cross-sectional view illustrating the inner case coupled to the cold air duct illustrated in FIG. 7.

Hereinafter, an example arrangement of the supply duct 330 will be described with reference to FIGS. 6 to 8. FIG. 6 is a side cross-sectional view showing an example coupling structure between the inner case 10 and the cold air duct 300 of FIG. 3, FIG. 7 illustrates another example arrangement of the cold air duct 300 connected to the door, and FIG. 8 is a side cross-sectional view showing the coupling structure between the inner case 10 and the cold air duct 300 illustrated in FIG. 7.

Referring to FIG. 6, the supply duct 330 protrudes into the side surface 15 of the first storage compartment 2 and may be visible in the first storage compartment 2. In order to mount the supply duct 330, a mounting portion 18 is provided in the side surface 15 of the first storage compartment 2 so that one side thereof is indented toward the outer case 20. When the supply duct 330 is mounted in the mounting portion 18, only a portion of the supply duct 330 is exposed to the first storage compartment 2.

In this case, as described below, a sufficient distance between the supply duct 330 and the outer case 20 may be secured to enable heat insulation therebetween without a separate insulator and to allow the supply duct 330 to be exposed to the first storage compartment 2 so that the cooling of the basket is visible.

For example, when the supply duct 330 is mounted in the mounting portion 18, the distance between the supply duct 330 and the outer case 20 is less than the distance between the inner case 10 and the outer case 20.

Cold air of approximately 8 degrees below the zero degrees is introduced into the suction duct 310, and cold air having a temperature lower than the temperature of the first storage compartment 2 flows to the supply duct 330. Therefore, dew formation may occur on the inner case 10 close to the mounting portion 18, for example, the side surface 15 of the first storage compartment 2, and may also occur on the outer case 20 close to the mounting portion 18.

As heat transfer may occur between the supply duct 330 mounted in the mounting portion 18 and the outer case 20, the temperature of cold air may increase rather than be maintained at a temperature.

To maintain the temperature of cold air, the distance between the mounting portion 18 and the outer case 20 may be determined to be equal to or greater than a reference value. For example, the width A2 of the supply duct may be approximately 20 mm, and the distance A3 between the mounting portion 18 and the outer case 20 may be set to approximately 28.5 mm. The distance A1 between the mounting portion 18 and the supply duct 330 may be set to approximately 4 mm. In some cases, the space between the mounting portion 18 and the outer case 20 may be defined without a separate insulator. In other cases, an insulator may be located at the space between the mounting portion 18 and the outer case 20.

Accordingly, the temperature of cold air discharged through the cold air discharge hole 350 reaches approximately 2.5 degrees below the zero degrees. The temperature of cold air to be discharged is realized by the distance between the mounting portion 18 and the outer case 20, the connection relationship between the suction duct 310 and the cold air supply unit 500, the angle at which cold air is discharged from the supply duct 330, and the like.

In some implementations, as illustrated in FIGS. 7 and 8, the supply duct 330 may be fully embedded in the side surface 15 of the first storage compartment 2 so as not to be exposed to the first storage compartment 2.

In this example, the suction duct 310 is not exposed to the first storage compartment 2 because the suction duct 310 is located between the inner case 10 and the outer case 20. For example, the width B2 of the supply duct may be approximately 20 mm, and the distance B3 between the mounting portion 18 and the outer case 20 may be set to approximately 19.5 mm. The distance B1 between the mounting portion 18 and the supply duct 330 is set to approximately 12 mm.

In this case, the supply duct 330 is not visible from the side surface 15 of the first storage compartment 2 and only the cold air discharge hole 350 is exposed, which may realize tidy design. In addition, since the inner case 10 is disposed between the first storage compartment 2 and the supply duct 330, dew formation on the side surface 15 of the first storage compartment 2 may be reduced.

In examples where the distance between the supply duct 330 and the outer case 20 are not sufficiently provided, a separate insulator 23 may be provided on the inner surface of the outer case 20.

The insulator 23 may be formed of a foamed material, or a vacuum insulation panel (VIP). In some cases, class wool may be used in the vacuum insulation panel. When the insulator is disposed between the supply duct 330 and the outer case 20, dew formation on the exterior of the outer case 20 may be prevented.

In some examples, the suction duct 310 is continuously exposed to the first storage compartment 2. As described above, cold air introduced into the suction duct 310 is approximately 8 degrees below the zero degrees, and is lower than the temperature of the first storage compartment 2. As a consequence, dew formation may occur on the outer surface of the suction duct 310. To prevent this, an insulator may be also provided inside of the suction duct 310.

In some cases, the suction duct 310 may not include an insulator, and an entrance of the suction duct 310 (e.g., a portion which is connected to the cold air supply unit 500 and is exposed to the first storage compartment 2) may be set to approximately 2.8 degrees below the zero degrees, and a portion of the suction duct 310, which is connected to the supply duct 330, may be set to approximately 1.8 degrees below the zero degrees. In some cases, a portion of the supply duct 330, which is exposed to the first storage compartment 2, may be set to approximately 0.4 degrees below the zero degrees. Here, the temperature of the dew point is approximately 1.92 degrees below the zero degrees. As a consequence, when the suction duct 310 is provided with an insulator, such dew formation may be prevented.

In some examples, a freezing compartment is provided, separately from the first storage compartment 2, which is the refrigerating compartment as described above, and a cold air supply device may be separately provided to supply cold air into the freezing compartment.

Hereinafter, the operation described above will be described with reference to the accompanying drawings.

Cold air, which is generated via heat exchange in the cold air supply unit 500, is supplied through the multi-duct 90 and the cold air duct 300, which communicate with the shroud 550.

Outside air, which has heat-exchanged with the evaporator 510, is discharged to the shroud 550 by the blowing fan 530, so that some of the air is discharged to the multi-duct 90 through the open top side thereof while maintaining a high pressure. The remaining air is discharged to the suction duct 310 through the front through-hole 556 and the side through-hole 557.

The cold air forms the first flow path F1 by passing through the front through-hole 556, and forms the second flow path F2 by passing through the side through-hole 557. Thus, the resistance, which may occur in the connecting portion of the shroud 550 and the suction duct 310, may be minimized.

The cold air moved along the multi-duct 90 is supplied to the first storage compartment 2 through the discharge holes.

The cold air moved along the suction duct 310, which is located in the lower end portion of the first storage compartment 2, is turned to again move along the supply duct 330, and thereafter, is discharged toward the second lower storage compartment 403 through the cold air discharge hole 350.

The cold air moves in the diagonal direction, for example, in a direction that is inclined by a predetermined angle from the side surface 15 of the first storage compartment 2.

At this time, the moving cold air is supplied to the second lower storage compartment 403 of the inner door 40 only when the inner door 40 is in the closed state. This is because the distance between the cold air introduction hole 432 and the cold air discharge hole 350 is long and the second slope 433 having the cold air introduction hole 432 does not face the first slope 340 when the inner door 40 is rotated to open the first storage compartment 2.

The cold air introduced into the second lower storage compartment 403 of the inner door 40 cools the second storage compartment 42, and thereafter is discharged to the first storage compartment 2 through the lower cover cold air hole 46*a*.

In some examples, when the user rotates the inner door 40 to open the first storage compartment 2, the cold air is no longer supplied to the second storage compartment 42 through the cold air duct 300.

As is apparent from the above description, a refrigerator has the following effects.

Implementations of the present disclosure may improve the quality of storage of food by directly supplying cold air to a home bar provided in a door so as to allow the home bar to maintain a sufficiently low temperature.

Implementations of the present disclosure may reduce manufacturing costs without requiring a separate cooling device for supplying cold air to the home bar.

Implementations of the present disclosure may realize an even temperature distribution in an upper space and a lower space of the home bar.

Although the exemplary implementations have been illustrated and described as above, it will be apparent to those skilled in the art that the implementations are provided to assist understanding of the present disclosure and the present disclosure is not limited to the above described particular implementations, and various modifications and variations can be made in the present disclosure without departing from the spirit or scope of the present disclosure, and the modifications and variations should not be understood individually from the viewpoint or scope of the present disclosure.

What is claimed is:

1. A refrigerator comprising:

a cabinet that defines a first storage compartment and an opening at a front side of the first storage compartment;

an inner door configured to open and close at least a portion of the first storage compartment, the inner door defining a second storage compartment configured to store one or more items;

an outer door configured to open and close at least a portion of the second storage compartment;

a cold air supply unit configured to supply cold air to each of the first storage compartment and the second storage compartment; and a cold air duct located in the first storage compartment and configured to, based on the inner door being oriented in an open position or a closed position, selectively communicate with the cold air supply unit and the second storage compartment, wherein the cold air supply unit is located at a rear side of the first storage compartment, wherein the cold air duct comprises:

a suction duct located on a rear surface of the first storage compartment and configured to receive cold air from the cold air supply unit, a supply duct located on a side surface of the first storage compartment and connected to the suction duct, the supply duct being configured to receive cold air from the suction duct and supply the received cold air to the inner door, a heat exchanger configured to generate cold air by exchanging heat with air received from outside of the refrigerator, a fan configured to cause cold air to flow toward the cold air duct, and a shroud that supports the fan and that is configured to communicate with the cold air duct, wherein the refrigerator further comprises an expansion portion located at a connecting portion between the suction duct and the shroud, wherein a cross-sectional area of the expansion portion is greater than a cross-sectional area of the shroud, and wherein the suction duct is connected to the shroud and is located forward of the shroud.

2. The refrigerator according to claim 1, further comprising a hinge unit located at a first side of the cabinet and configured to rotatably couple the inner door to the cabinet, wherein the cold air duct extends from a first position in the first storage compartment toward the first side of the cabinet, and is configured to supply cold air through a side surface of the inner door that is located closer to the first side of the cabinet than to the first position in the first storage compartment.

3. The refrigerator according to claim 1, wherein the supply duct comprises a first inclined surface that slopes with respect to the side surface of the first storage compartment and that defines a cold air discharge hole configured to communicate with the inner door.

4. The refrigerator according to claim 3, wherein the inner door comprises a second inclined surface that slopes with respect to the side surface of the first storage compartment, that is configured to face the first inclined surface of the supply duct, and that defines a cold air introduction hole configured to receive cold air from the supply duct through the cold air discharge hole.

5. The refrigerator according to claim 1, wherein the second storage compartment comprises an upper storage compartment and a lower storage compartment located vertically below the upper storage compartment, and wherein the cold air duct is configured to supply cold air to the lower storage compartment.

6. The refrigerator according to claim 1, wherein the cabinet comprises an inner case that defines the first storage compartment, and an outer case that surrounds the inner case, and wherein the cold air supply unit is located between the inner case and the outer case and is configured to communicate with the cold air duct.

7. The refrigerator according to claim 6, wherein the suction duct is located on an inner surface of the inner case.

8. The refrigerator according to claim 7, wherein the suction duct comprises an insulator configured to insulate the suction duct from the first storage compartment.

9. The refrigerator according to claim 6, wherein the cold air duct protrudes from an inner surface of the inner case toward an interior of the first storage compartment.

10. The refrigerator according to claim 9, wherein the inner case covers at least a portion of the supply duct.

11. The refrigerator according to claim 10, wherein the inner case comprises a duct mounting portion that defines a recess configured to receive the supply duct, and wherein the duct mounting portion is spaced apart from the outer case by a distance and is configured to insulate the supply duct from the outer case.

12. The refrigerator according to claim 6, wherein the suction duct protrudes from an inner surface of the inner case toward an interior of the first storage compartment, and wherein the supply duct is located between the inner case and the outer case.

13. The refrigerator according to claim 12, wherein the outer case comprises an insulator located on an inner surface of the outer case that faces toward the supply duct.

14. The refrigerator according to claim 2, wherein the supply duct is configured to:

separate from the inner door based on the inner door opening the first storage compartment by rotation of the hinge unit in a first direction; and connect to the inner door based on the inner door closing the first storage compartment by rotation of the hinge unit in a second direction opposite to the first direction.

15. The refrigerator according to claim 4, wherein the cold air introduction hole is configured to, based on the inner door being oriented in a closed position, communicate with the cold air discharge hole.

16. The refrigerator according to claim 11, wherein a width of the supply duct is less than the distance between the duct mounting portion and the outer case.

17. The refrigerator according to claim 16, wherein the supply duct is spaced apart from the duct mounting portion by a distance that is less than the width of the supply duct.

18. A refrigerator comprising:

a cabinet that defines a first storage compartment and an opening at a front side of the first storage compartment;

an inner door configured to open and close at least a portion of the first storage compartment, the inner door defining a second storage compartment configured to store one or more items;

an outer door configured to open and close at least a portion of the second storage compartment;

a cold air supply unit configured to supply cold air to each of the first storage compartment and the second storage compartment;

a cold air duct located in the first storage compartment and configured to, based on the inner door being oriented in an open position or a closed position, selectively communicate with the cold air supply unit and the second storage compartment; and a hinge unit located at a first side of the cabinet and configured to rotatably couple the inner door to the cabinet, wherein the cold air duct extends from a first position in the first storage compartment toward the first side of the cabinet, and is configured to supply cold air through a side surface of the inner door that is located closer to the first side of the cabinet than to the first position in the first storage compartment, wherein the cold air supply unit is located at a rear side of the first storage compartment, wherein the cold air duct comprises:

a suction duct located on a rear surface of the first storage compartment and configured to receive cold air from the cold air supply unit, and a supply duct located on a side surface of the first storage compartment and connected to the suction duct, the supply duct being configured to receive cold air from the suction duct and supply the received cold air to the inner door, wherein the cabinet comprises an inner case that defines the first storage compartment, and an outer case that surrounds the inner case, wherein the cold air supply unit is located between the inner case and the outer case and is configured to communicate with the cold air duct, wherein the cold air supply unit comprises:

a heat exchanger configured to generate cold air by exchanging heat with air received from outside of the refrigerator, a fan configured to cause cold air to flow toward the cold air duct, and a shroud that supports the fan and that is configured to communicate with the cold air duct, and wherein the suction duct is located on an inner surface of the inner case.

19. A refrigerator comprising:

a cabinet that defines a first storage compartment and an opening at a front side of the first storage compartment, wherein the cabinet comprises an inner case that defines the first storage compartment, and an outer case that surrounds the inner case;

an inner door configured to open and close at least a portion of the first storage compartment, the inner door defining a second storage compartment configured to store one or more items;

an outer door configured to open and close at least a portion of the second storage compartment;

a cold air supply unit configured to supply cold air to each of the first storage compartment and the second storage compartment; and a cold air duct located in the first storage compartment and configured to, based on the inner door being oriented in an open position or a closed position, selectively communicate with the cold air supply unit and the second storage compartment, wherein the cold air supply unit is located at a rear side of the first storage compartment, wherein the cold air duct comprises:

a suction duct located on a rear surface of the first storage compartment and configured to receive cold air from the cold air supply unit, and a supply duct located on a side surface of the first storage compartment and connected to the suction duct, the supply duct being configured to receive cold air from the suction duct and supply the received cold air to the inner door, and wherein the suction duct is located on an inner surface of the inner case and comprises an insulator configured to insulate the suction duct from the first storage compartment.

* * * * *